US006644423B2

(12) United States Patent
Bratton et al.

(10) Patent No.: US 6,644,423 B2
(45) Date of Patent: Nov. 11, 2003

(54) WIRELINE SYSTEM FOR MULTIPLE DIRECT PUSH TOOL USAGE

(75) Inventors: Wesley L. Bratton, Richland, WA (US); Stephen P. Farrington, Stockbridge, VT (US); James D. Shinn, II, South Royalton, VT (US); Darren C. Nolet, Hartland, VT (US)

(73) Assignee: Applied Research Associates, Inc., Albuquerque, NM (US)

( * ) Notice: Subject to any disclaimer, the term of this patent is extended or adjusted under 35 U.S.C. 154(b) by 0 days.

(21) Appl. No.: 09/916,226

(22) Filed: Jul. 27, 2001

(65) Prior Publication Data

US 2002/0020560 A1 Feb. 21, 2002

Related U.S. Application Data

(60) Provisional application No. 60/221,165, filed on Jul. 27, 2000.

(51) Int. Cl.[7] ..... E21B 11/02; E21B 7/26; E21B 47/026; E21B 49/00

(52) U.S. Cl. ..... 175/58; 175/20; 175/50

(58) Field of Search ..... 166/66, 250.02, 166/250.16, 242.6, 382; 175/20, 50, 58; 73/152.11, 152.54

(56) References Cited

U.S. PATENT DOCUMENTS 3,507,124 A 4/1970 Turzillo
3,869,869 A 3/1975 Pao Chen
4,466,497 A * 8/1984 Soinski et al. ..... 175/236
5,150,622 A * 9/1992 Vollweiler ..... 175/20
5,497,091 A 3/1996 Bratton et al.
5,698,799 A 12/1997 Lee, Jr. et al.
5,744,730 A 4/1998 Ballard et al.
5,819,850 A 10/1998 Lee, Jr. et al.
5,886,253 A 3/1999 Joustra
5,921,328 A 7/1999 Babineau et al.
5,992,543 A * 11/1999 Soinski et al. ..... 175/247
6,098,448 A * 8/2000 Lowry et al. ..... 175/21
6,208,940 B1 * 3/2001 Kram et al. ..... 702/11

* cited by examiner

*Primary Examiner*—David Bagnell
*Assistant Examiner*—Brian Halford
(74) *Attorney, Agent, or Firm*—Fish & Richardson P.C.

(57) ABSTRACT

A tool latching and retrieval system allows the deployment and retrieval of a variety of direct push subsurface characterization tools through an embedded rod string during a single penetration without requiring withdrawal of the string from the ground. This enables the in situ interchange of different tools, as well as the rapid retrieval of soil core samples from multiple depths during a single direct push penetration. The system includes specialized rods that make up the rod string, a tool housing which is integral to the rod string, a lock assembly, and several tools which mate to the lock assembly.

25 Claims, 7 Drawing Sheets

WIRELINE SYSTEM FOR MULTIPLE DIRECT PUSH TOOL USAGE

This application claims the benefit of priority from prior U.S. provisional application Ser. No. 60/221,165, filed Jul. 27, 2000.

This invention was made with Government support under DE-AR26-98FT40366 awarded by the United States Department of Energy. The Government has certain rights in the invention.

FIELD OF THE INVENTION

The present invention relates to a device and method for conducting geotechnical and geoenvironmental measurements using direct push tools, and more particularly to a latching and retrieval system that allows the in situ interchange of several different tools including, but not exclusively, an electric cone penetrometer, a soil core sampler, a soil vapor sampler, and a grouting device, all through an embedded direct push rod string without requiring withdrawal of the string. The device also allows the collection and retrieval of soil core samples from multiple depths during a single penetration without requiring withdrawal of the rod string.

BACKGROUND OF THE INVENTION

Currently, the use of multiple direct push tools during a site characterization (i.e., piezocone, chemical sensors, core sampler, grouting tool) must be accomplished by withdrawing the entire penetrometer rod string to change tools. This practice results in multiple penetrations being required during characterization of a site, and to subsequently seal the resulting multitude of holes with grout.

SUMMARY OF THE INVENTION

The present invention allows multiple tools to be interchanged during a single penetration without withdrawing the rod string from the ground. This allows more work to be accomplished and reduces overall costs as time is not wasted pulling rods back out of the ground to change tools or retrieve soil core samples.

The implementation of a wireline tool approach to direct push technologies is unique from drilling implementations because in contrast to drilling (1) direct push incorporates direct sensing tools at the tip of the rod string, (2) direct push relies entirely on the transmission of axial force through instruments at the tip of the rod string to penetrate the earth, and (3) direct push tools are used to measure in situ stresses, electrical properties, the presence of chemical, and other properties as a means of characterization. Because of these differences direct push uses smaller diameter casings than drilling, with relatively greater wall thickness, and requires the accommodation of electrical cabling and/or optical fibers within the rod string.

The wireline system for multiple direct push tool usage of the present invention is composed of several components which are similar in function to conventional direct push and cone penetrometer technology (CPT) equipment used for in situ geoenvironmental. site characterization. Conventional equipment uses either a heavyweight push truck to advance tools into the earth under static load (cone penetration testing), or a percussion hammer approach using a lighter rig. The electronic probes are instrumented and signals are transmitted to the surface via electrical cable and/or fiber optics strung through the center of the hollow push rods. Also typical is the simple collection of multiple soil core samples.

With the wireline system of the present invention, the same method is used to advance the rod string into the earth. However, in the present invention, the first rod (i.e., the deepest one) has a provision for a latching mechanism that allows various tools to be locked into and unlocked from the rod string, as well as retrieved and deployed through the rod string while the rod string remains embedded in the ground. This system allows instrumented probes and samplers, as well as other tools, to be used during a single penetration.

The wireline system consists of six major components:

rods,
latching mechanism,
soil core sampler,
piezocone module,
vapor sampler, and
grout module.

Rods: The push rods have a relative wall thickness (about 19% of the diameter) exceeding that a typical drive casings used with drilling technologies because direct push systems do not rely on rotary action, cutting bits, or augers to remove material from the path of the rod string, and thus must support the transmission of greater axial load relative to casing diameter than drilling systems in order to penetrate the earth. Typical direct push rod diameters range from about one inch to two and a quarter inches.

The wireline rod string of the present invention has a two-inch outer diameter and a one and one-quarter inch inner diameter. The shouldered joints of the one-meter rod segments are joined by double-lead rope threads which connect faster and sustain greater loading than V-threads.

The rod string optionally incorporates occasional rod expanders (one on every fifth or sixth rod in the string). Expanders are rings welded to the outside of the rods which widen the borehole beyond the normal outside diameter of the rod segments as they pass into the earth, thus creating an annular void between the earth and the normal outer rod surface which alleviates sidewall friction that can accumulate along the embedded length of the rod string. By this action, the expanders enable deeper penetration in some soils than would be achievable without them when using the system.

Latching Mechanism: The latching mechanism comprises two main components, one stationary and the other removable. The stationary component is also the lowermost push rod segment. It is a specialized segment called the tool housing which embodies the receiving mechanism for the removable element. The removable element is the lock assembly.

The lock assembly employs two horizontally opposed, hinged locking dogs which lock the tools into place by rotating outward to occupy a receiving groove in the inside surface of the tool housing. The dogs are held in the locked position by a locking wedge which slides vertically between them. This dog arrangement allows the axial stress on the direct push tools from application of static force, rapid percussion, or other dynamic loading to be distributed over a greater bearing area than on systems used in conventional drilling.

This fulfills the unique requirement of the direct push application for more bearing capacity than required in wireline drilling arrangements because direct push tools encounter the stress of penetration, which must be transferred to the rod string, whereas with drilling, less axial stress is generated on the tools and the outer casing carries most of the bearing load directly. When the locking dogs are in the engaged position, a spring-loaded locking wedge rests between them, preventing retraction of the dogs.

A retraction system allows disengagement of the locking dogs in the latching mechanism by displacement of a spring-loaded locking wedge which travels vertically between the dogs and has a conic outer surface at its base, a cylindrical outer surface above the conic surface, and a smaller diameter shaft above that. The dogs have a vertical inner surface that is beveled at the top, such that when the dogs are not engaged, the wedge must be in a raised position with its conic surface acting against the complementary beveled surface on the dogs, but when the dogs are engaged, the wedge is in a lower position with its vertical surface acting against a vertical surface on the interior of the dogs.

The nature of the contact between the wedge and the dogs disallows retraction of the dogs when the vertical surfaces are in contact, regardless of the inward force exerted on the dogs by the receiving groove, but allows the dogs to retract in response to inward force when the wedge has been raised enough that the conic surfaces are in contact. When not counteracted for retrieval, a compression spring around the shaft of the locking wedge keeps the wedge in the downward position.

The lock mechanism allows the deployed tool to lock into place upon reaching an appropriate depth. A landing nut allows free fall deployment of tools, fine tuning of lock clearances, and easy replacement of the most wear-receiving parts.

The tool housing is a specialized version of the individual rods segments that compose the rod string. First, it is shorter than the one-meter length of the other rods. Second, while the inner diameter of most of the tool housing is identical to that of the individual rods in the string, the tool housing adds a receiving groove of wider diameter than the rod inner diameter, and an interior threaded section which holds the landing nut of lesser inner diameter than the rods.

In the retracted position, the outer surface of the dogs is contained within a smaller diameter than the interior of the rods, but larger than the inner diameter of the landing nut, so the landing nut stops the dogs from overshooting the receiving groove and keeps tools from overextending beyond the bottom of the rod string. The nut also provides the ability to adjust the receiving groove size so that the fit of the locking dogs can be fine-tuned. The system is designed such that the nut receives the impact of falling tools, and is easily replaced if wear becomes an issue.

A compression spring surrounds the shaft of the locking wedge. This spring causes the locking wedge to exert an outward force on the locking dogs whenever they are partially or fully retracted. This outward force has several advantages. First, it causes instant extension of the dogs into the engaged position when the receiving groove in the tool housing is encountered. Second, it keeps tools centered in the rod string as they are lowered down to the tip for deployment. There is always an outward component of force on the locking dogs, whenever they are not fully extended and the retrieval wire is free of tension.

The chamfered lower edge of the locking dogs allows them to skate over discontinuities and imperfections in the interior rod surface, such as where joints occur in the rod string. The action of the dogs as they skate down the interior surface of the rods also results in cleaning of the surface,.by scraping impurities from the surface and allowing them to drop out the open bottom of the rod string.

Finally, once the dogs are engaged in the receiving groove, the spring-loading of the locking wedge prevents vertical displacement of the wedge from between the locking dogs that would allow the dogs to retract and disengage under the rod acceleration induced by vibratory or percussion driving. The wedge also has a hole through the center to allow the pass-through of electrical wiring, a grout tube, or optical fibers to the tools below.

Tools are retrieved by pulling up a retrieval wire attached to the locking wedge by a connector block. This removes the locking wedge from between the dogs and allows the dogs to retract under the load of the tool pushing the dogs against the upper, beveled surface of the receiving groove. Tools are redeployed by lowering them down the rod string using the retrieval cable until they come to rest against the landing nut, and the dogs snap into place in the tool housing.

Piezocone: The piezocone tool incorporates standard gauges for tip stress, sleeve stress and pore pressure. The system is designed such that the piezocone can be lowered down the rod interior and locked into place. Once locked in place the piezocone and the rod can be advanced together.

The system is capable of unlocking the probe at any depth for installation of either a dummy tip, another probe, or the grouting tool. The wireline piezocone tool is 1.125 inches in diameter. This diameter corresponds to a 6.5 $cm^2$ projected cone area.

The piezocone maintains appropriate ratios of sleeve area to tip area. The probe mandrel and probe body are sized relative to each other such that if sufficient bending stress to break the tool were developed in the subsurface during deployment, the probe would fail at the mandrel rather than at the body, thus minimizing the potential for damage to other wireline system components.

Soil Sampler: The soil sampler tool allows the collection and retrieval of core samples from multiple depths during a penetration without requiring retraction of the CPT rods from the ground. The sample barrel produces a one-inch diameter, 12-inch long core of soil, accommodates the use of a plastic retainer basket (for loose soils), and is easily separable from the locking mechanisms and basket retainer nut. Either end of the barrel connects to these other parts, or to end plugs used for sealing the sample. The nut used to hold in the retainer basket receives the tip soil stress and prevents wear or damage to the leading edge of the core barrel.

Grouting Module: The system includes a grouting module to permit grouting a penetration upon retraction of the rod string, such that the entire void created by the penetration process is filled with grout. The tool allows the grout to flow from the down-hole end of the rod string during retraction to ensure that the entire void created by the penetration process is filled with grout. This approach to grouting meets the regulatory guidelines of most Environmental Protection Agency (EPA) regional offices.

Tubing is used to transport the grout from the pump to the grouting tool at the end of the rod string. The grouting tool locks in place at the end of the down-hole end of the push rods and is interchangeable with the piezocone and other tools.

Prior to the present invention, the use of multiple characterization tools at a single location during a direct push investigation required typically at least 100% (1×) re-penetration (for grouting) and as much as 2000% (20×) re-penetration (for collecting continuous soil core samples).

The manner in which the invention allows multiple tools to be used in a single penetration and allows the retrieval of several soil core samples during a single penetration without withdrawing the rods results in a remarkable time savings for continuous sampling activities. In most cases, it will completely eliminate the incidence of re-penetration. Data from field demonstrations of the invention have indicated time savings of up to 75% for a typical characterization.

Once the penetration has begun, a typical one-foot direct push wireline soil sample can be collected every two to three minutes, whereas conventional direct push soil sampling averages about 10 to 15 minutes per foot.

Additionally, it is a requirement of some environmental regulators that the borehole created by a CPT sounding or collection of samples in a contaminated area be sealed with grout upon retraction of the borehole casing. This has prohibited the application of direct push technology in some areas, whereas the present invention allows grouting upon retraction by exchange of the characterization tools with the grouting tool. The ability to place grout in the same hole upon withdrawal also eliminates the possibility of creating a new hole when a hole has to be repenetrated to complete a grouting operation.

Although the use of wireline tools in conjunction with drilling for subsurface characterization has been well established, applying wireline concepts to direct push technology is novel and unique from drilling implementations. In contrast to drilling, direct push technology (1) usually incorporates direct sensing tools at the tip of the rod string, (2) subjects the tools at the tip of the rod string to greater axial force that must be transferred to the rod string, in order to penetrate the earth, and (3) direct push tools are used to measure in situ stresses, electrical properties, the presence of chemical, and other properties as a means of characterization during penetration. Because of these differences direct push typically uses smaller diameter casings than drilling, with relatively greater wall thickness, and requires the accommodation of electrical cabling and/or optical fibers within the rod string. The use of semicircular locking dogs, to evenly distribute around the circumference of the rod the load transferred between the tools and the rod string, while allowing a hollow center for passing cables through is a unique advantage.

Another advantage of the latch design of a locking dog geometry is that it transforms axial load on the dogs to a radial compression load on the locking wedge. This removes load from the hinge pins and averts the need for parts with large cross-sectional areas to resist shear loads.

Because direct push technology is relatively new and offers many significant advantages over drilling for environmental characterization even without the use of wireline tools, few practitioners of the direct push technology recognize the potential for time saving and cost saving afforded by this approach.

Direct push systems incorporate rods that are relatively small diameter relative to drilling tools. Due to the size constraints of conducting mechanical latching operations inside a direct push rod, how to successfully develop a wireline system for multiple direct push tool usage has not been readily apparent to practitioners in the art.

Accordingly, it is an object of the present invention to use a direct push rod string for the measurement of soil parameters through the use of a series of replaceable measurement modules which are lowered through the rod string and locked in a tool housing in a leading end of the rod string and which can be released from the tool housing and withdrawn through the rod string for replacement with a different soil measuring module.

It is another object of the present invention to use a direct push rod string for the measurement of soil parameters through the use of a series of replaceable measurement modules which are lowered through the rod string and locked in a tool housing in a leading end of the rod string and which can be released from the tool housing and withdrawn through the rod string for replacement with a different soil measuring module by the use of a latching mechanism for securing the measurement module in the tool housing by two opposed locking dogs engaged by a locking wedge to force the dogs into a receiving groove on the interior surface of the tool housing and biasing the locking wedge for forcible retraction of the locking wedge by a wireline and allowing retraction of the dogs from the receiving groove for withdrawal of the measurement module or probe.

It is still yet another object of the present invention to use a direct push rod string for the measurement of soil parameters through the use of a series of replaceable measurement modules which are lowered through the rod string and locked in a tool housing in a leading end of the rod string and which can be released from the tool housing and withdrawn through the rod string for replacement with a different soil measuring module by the use of a latching mechanism for securing the measurement module in the tool housing by two opposed locking dogs engaged by a locking wedge to force the dogs into a receiving groove on the interior surface of the tool housing and biasing the locking wedge for retraction of the locking wedge by a wireline and allowing retraction of the dogs from the receiving groove for withdrawal of the measurement module with the locking dogs being chamfered on a lower edge to allow the dogs to skate over discontinuities in the rod string and having a chamfered upper edge to assist in retraction of the dogs from the receiving groove upon release of the dogs by the locking wedge.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
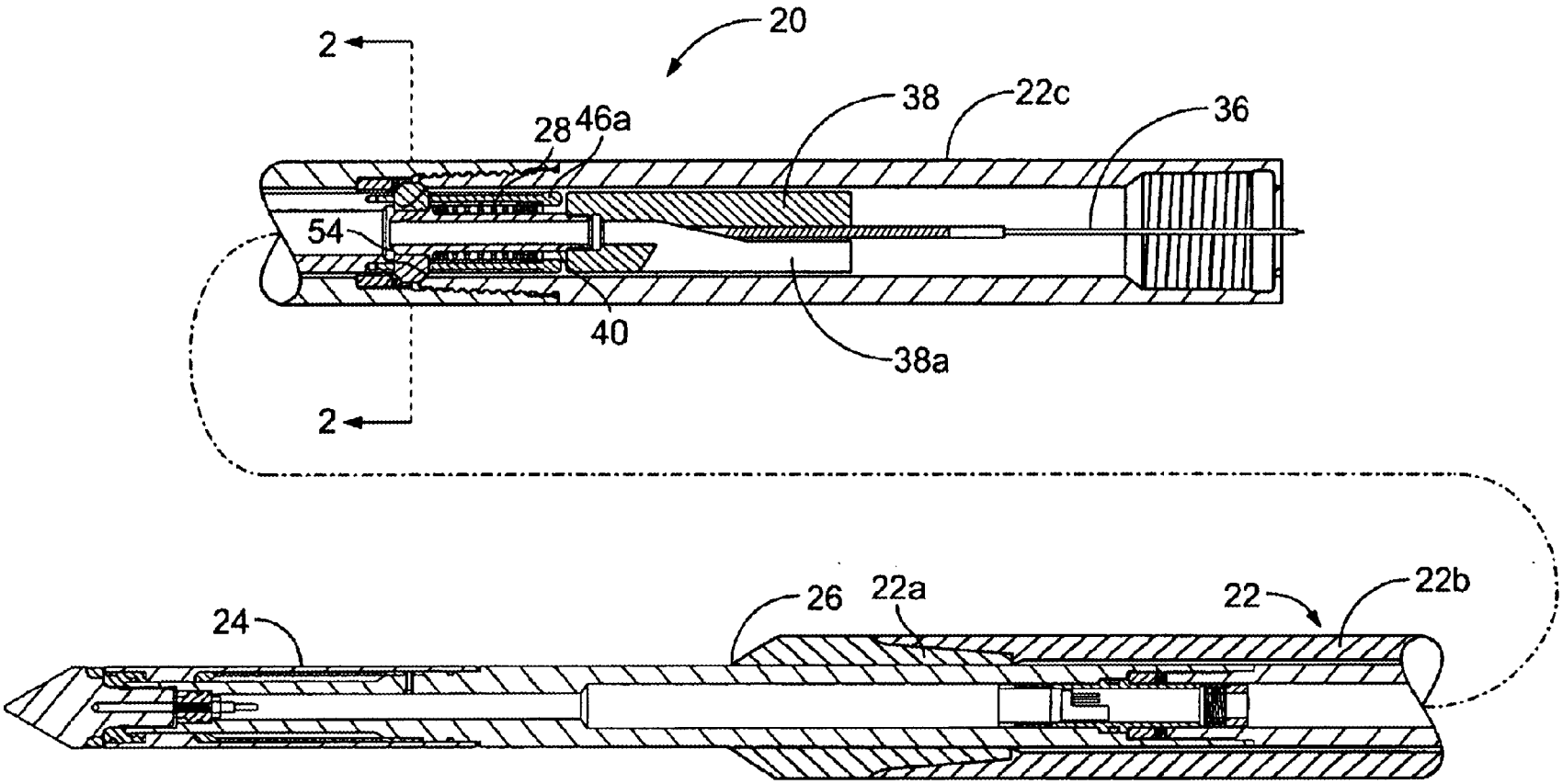
FIG. 1 is a sectional view of the wireline system of the present invention illustrating a wireline piezocone module in a locked position in a tool housing.
Figure 2:
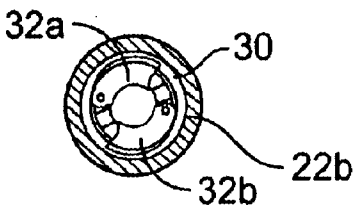
FIG. 2 is a cross-sectional view taken along line 2—2 of FIG. 1.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 4, in particular, a wireline system for multiple direct push tool usage embodying the teachings of the subject invention is generally designated as 20. With reference to its orientation in FIG. 1, the wireline system includes a rod string 22 including a plurality of assembled rod sections 22*a*, 22*b*, 22*c*, etc., which progressively extend upwards to ground level. The lowermost sections of the rod string 22 form a tool housing including a receiving mechanism for a removable element such as a soil core sampler, a piezocone module, a vapor sampler and a grout module, to name a few.

In FIG. 1, a piezocone module 24 for measuring tip stress, sleeve stress and pore pressure is shown projecting approximately 27 cm beyond the leading cutting mouth end of the rod string when locked in a deployment position. The piezocone module 24 is connected to a lock mechanism 28 for engaging with a receiving groove 30 on an interior surface of the tool housing, as a shown in the sectional view of FIG. 2. Opposed locking dogs 32*a*, 32*b* extend into the groove 30 to maintain a position of the piezocone module with respect to the rod string.

Figure 3:
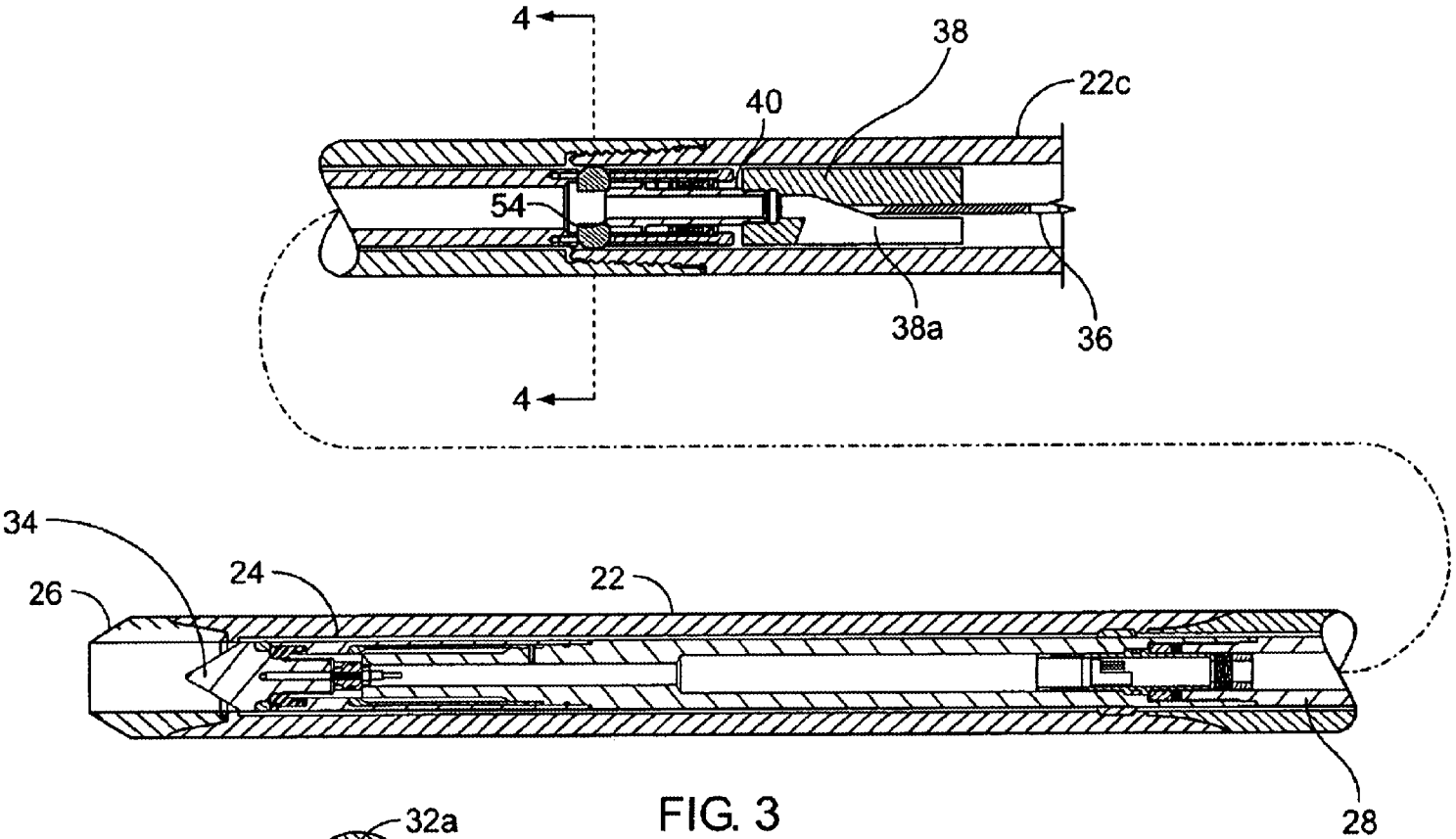
FIG. 3 is a sectional view of the wireline system of the present invention with a wireline piezocone module in an unlocked position so as to slide with respect to the tool housing.
Figure 4:
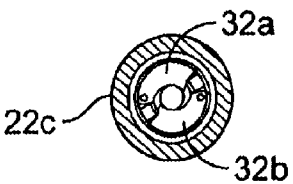
FIG. 4 is a cross-sectional view taken along line 4—4 of FIG. 3.

In FIGS. 3 and 4, the opposed locking dogs 32*a*, 32*b* have been retracted out of the receiving groove 30 and the piezocone module 24 is retracted through the rod string 22 so that the cone or tip 34 of the piezocone module is positioned upstream of the leading end 26 of the rod string. The retraction of the piezocone module 24 through the rod string is caused by a pulling force on the wireline 36 from above ground. The wireline is anchored within block 38, within which one end of locking wedge 40 is also mounted. Upward movement of the wireline against a bias force pulls locking wedge 40 upward and releases a radially outward force on the locking dogs 32*a*, 32*b*.

As shown in greater detail in FIGS. 5 through 8, a representative portion of the tool housing 42 is shown. At an uppermost portion of the measurement module to be inserted into the tool housing, whether it is a piezocone module, soil core sampler, vapor sampler, grout module or other testing sampler or module, is located a lock housing 44. Pivotally mounted on the lock housing 44 by pins 46*a*, 46*b* are locking dogs 32*a*, 32*b*. Slidably mounted between the locking dogs 32*a*, 32*b* is a locking wedge 48 which is hollow and is biased in the direction of arrow 50 by a spring (not shown).

The hollow interior of the locking wedge is used for passage through of optical cable or other instruments such as a multi-conductor cable. The construction of the block connector 38 in FIGS. 1 and 3, shown in FIGS. 17–20, includes a passageway 38*a* feed optical cable 200 (FIG. 13) or other instruments around wireline 36, through block connector 38, through locking wedge 40 and beyond the lock mechanism 28.

Connector block 38 includes threaded passageway 39 for receipt of a threaded end of the locking wedge. The opposite end includes a threaded opening 41 for receipt of a threaded end of the wireline.

Figure 5:
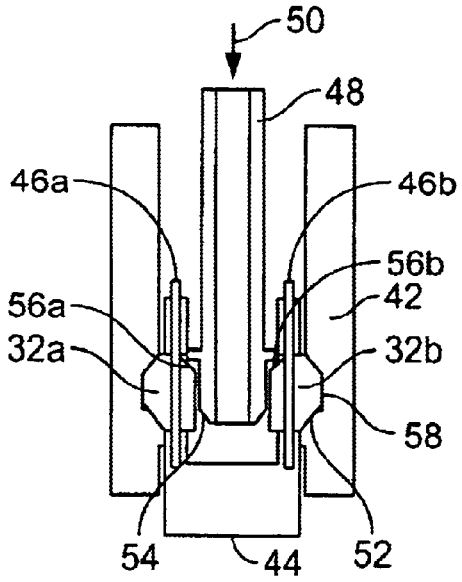
FIG. 5 is a schematic illustration of the latching mechanism in the locked position within a portion of the tool housing.
Figure 6:
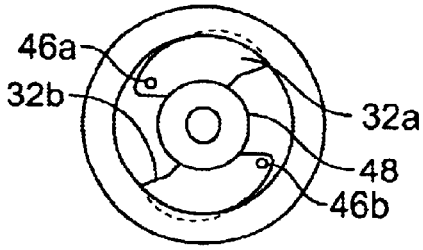
FIG. 6 is a cross-sectional view taken through the locking dogs in FIG. 5.

When the locking wedge is positioned as shown in FIG. 5, the dogs are prevented from further movement downward by engagement of the dogs with a landing nut 52 projecting into the interior of the tool housing 42. The movement of the locking wedge between the locking dogs causes engagement of a chamfered leading edge 54 of the locking wedge with a chamfered edge 56*a*, 56*b* of the locking dogs. In the positioning of the locking wedge between the locking dogs 32*a*, 32*b*, the locking dogs project radially outward into a receiving groove 58 of the tool housing.

Figure 7:
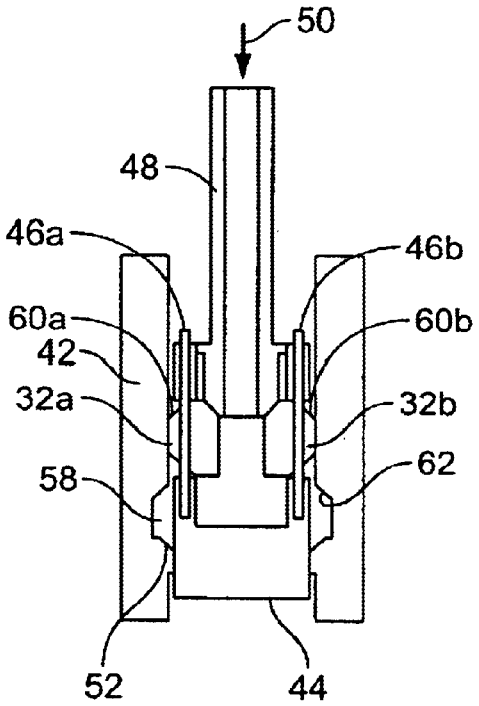
FIG. 7 is a schematic illustration of the latching mechanism in an unlocked position and partially withdrawn from the tool housing.
Figure 8:
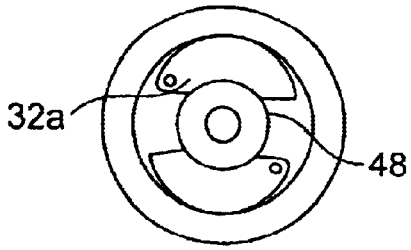
FIG. 8 is a cross-sectional view taken through the locking dogs of FIG. 7.

When the locking wedge 48 is moved against the bias force indicated by arrow 50 as shown in FIG. 7, the module or sampler is capable of being pulled by a wireline to force the locking wedge from between the locking dogs 32*a*, 32*b*. Chamfered edges 60*a*, 60*b* of the locking dogs slide along chamfered edge 62 of receiving groove 58 to swing about pivot pins 46*a*, 46*b* and move radially inward so as to be released from within the receiving groove 58. The module or sampler is thereby allowed to be retracted by the wireline and removed from the rod string. Another measurement or sampler module is then lowered through the rod string by a wireline until its locking mechanism engages within the receiving groove of the tool housing as shown in FIG. 5. The insertion of a new measurement or sampler module may be done after or during further advancement of the rod string to a different depth.

Figure 9:
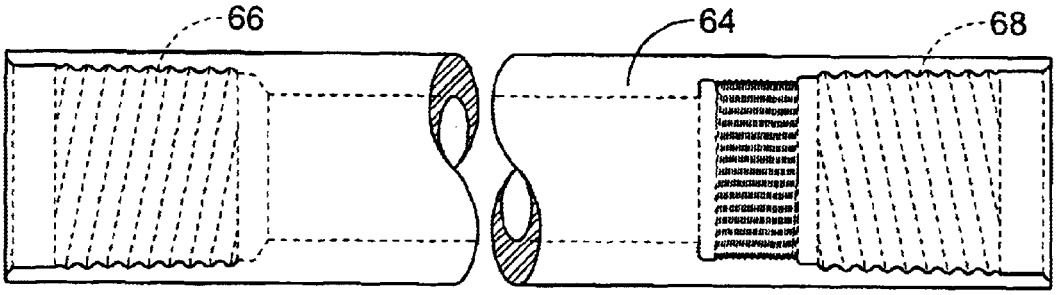
FIG. 9 is a side view of the leading section of the rod string (also called the tool housing), with the threading at opposite ends being illustrated in dotted lines.
Figure 10:
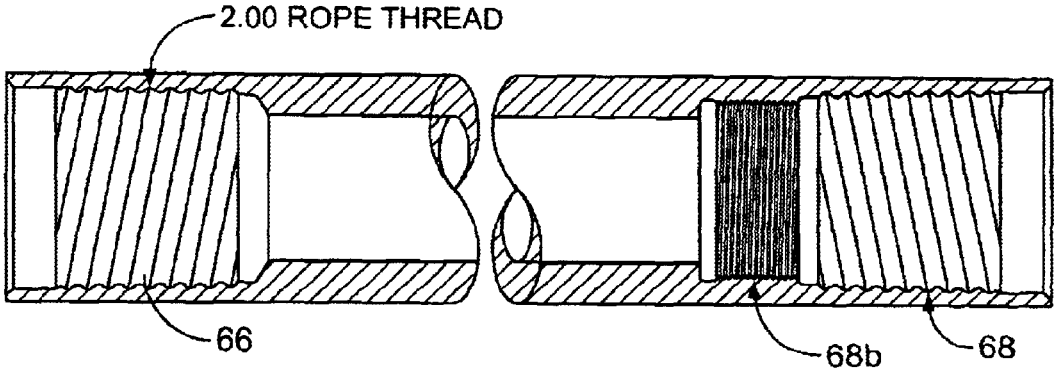
Figure 10 is a cross-sectional view of the section of the rod string shown in FIG. 9.

In FIGS. 9 and 10, a section of the rod string 64 is shown having female rope threaded portions 66 and 68 as shown in detail in FIG. 10. The rope threading 68 includes further threading 68*b*. Corresponding male threaded sections of the rod string are interengaged with the female threaded sections to extend the overall length of the rod string being pushed into the ground.

Figure 11:
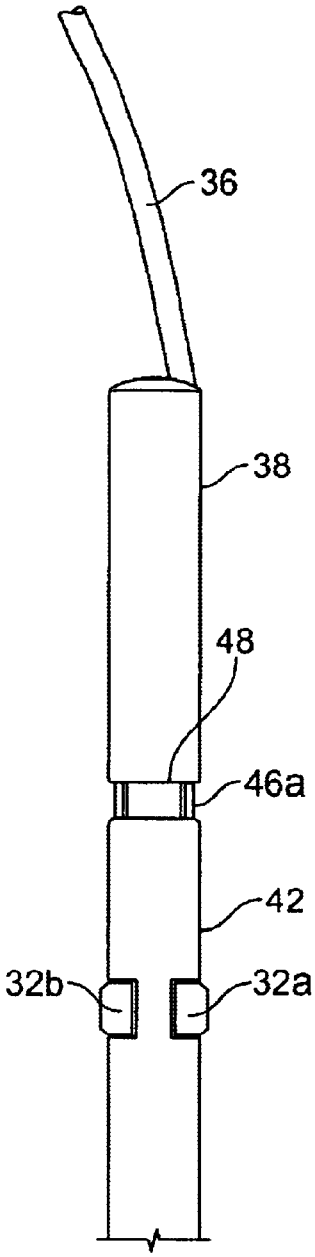
FIG. 11 illustrates a section of a measurement probe having a lock mechanism for securing the measurement probe within the tool housing of a rod string.
Figure 12:
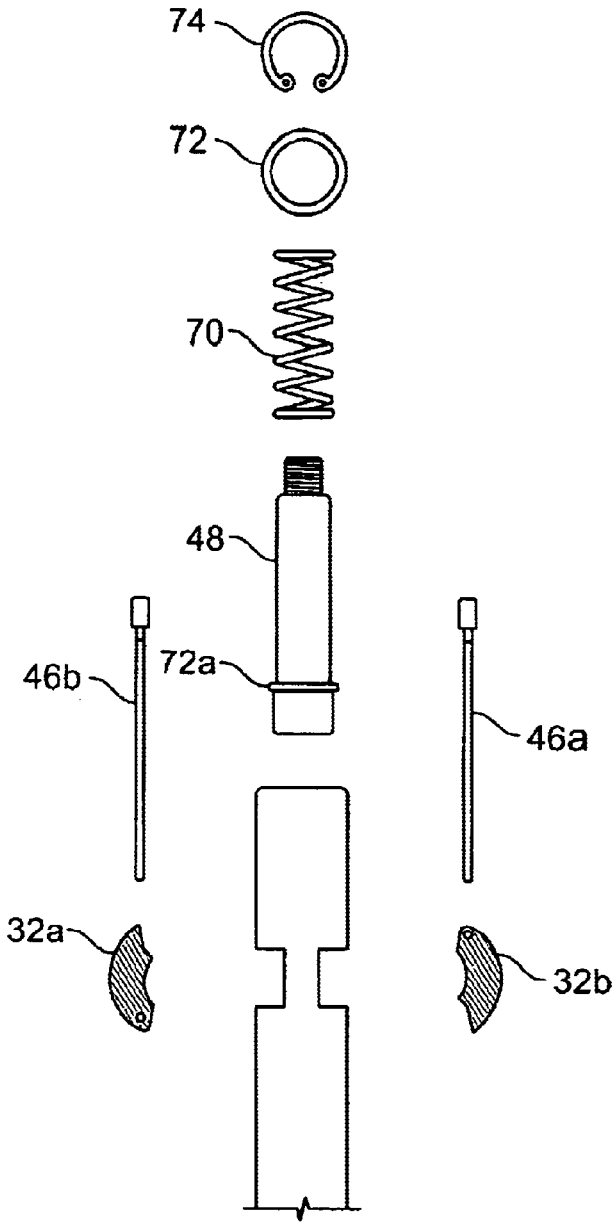
FIG. 12 is an exploded view of the lower portion of the lock mechanism shown in FIG. 11.

FIGS. 11 and 12 illustrate a locking mechanism for connection to a measurement or soil sampler module having locking dogs 32*a*, 32*b* being pivotally mounted in tool housing 42 by pins 46*a*, 46*b* with locking wedge 48 extending between the pins and the locking dogs. Block connector 38 is shown having wireline 36 projecting therefrom for retraction and lowering of a measurement or soil sampler module.

In FIG. 12, the exploded view shows the details of the locking wedge 48 with a surrounding compression spring 70. The compression spring is retained between a flange 72*a* adjacent to the lowermost end of the locking wedge and a washer 72 and a retaining ring 74 at an upper end of the locking wedge.

Figure 13:
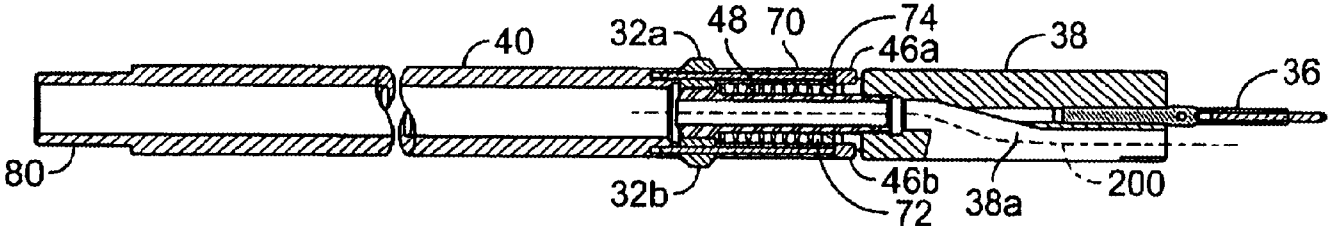
FIG. 13 is a cross-sectional view of the lock assembly illustrating the projection of the locking wedge dogs as forced radially outwardly by opposed locking wedge flanges.
Figure 14:
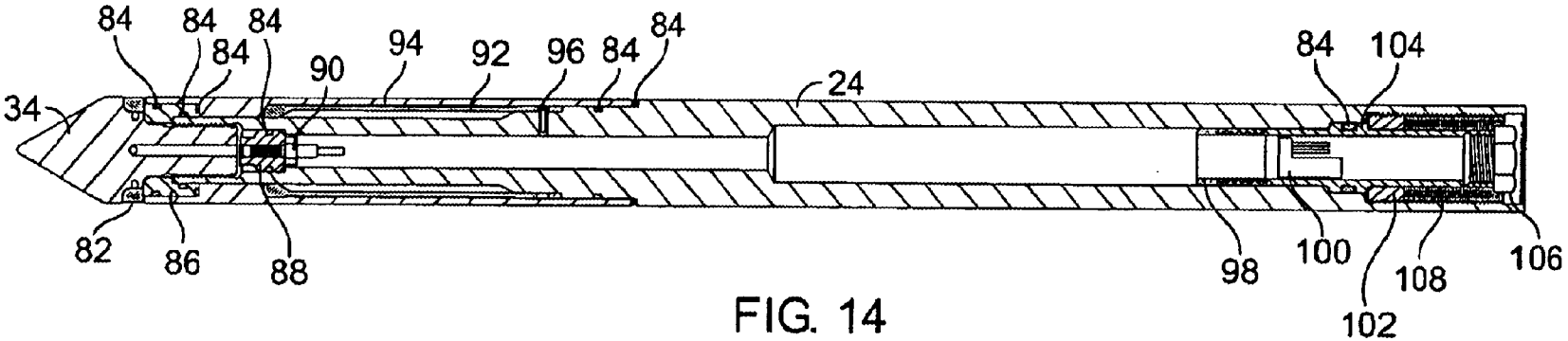
FIG. 14 is a cross-sectional view of a piezocone measuring module for insertion into the tool housing after passing through the rod string of the present invention.
Figure 15:
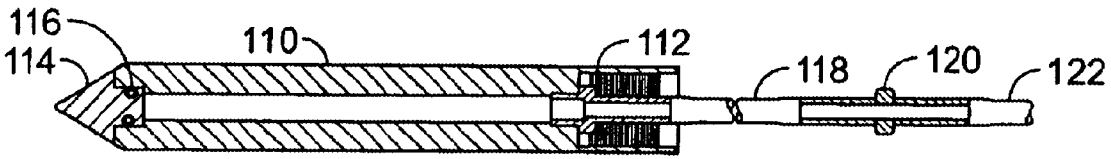
FIG. 15 is a cross-sectional view of a grout module assembly to be lowered into the tool housing after passing through the rod string of the present invention.
Figure 16:
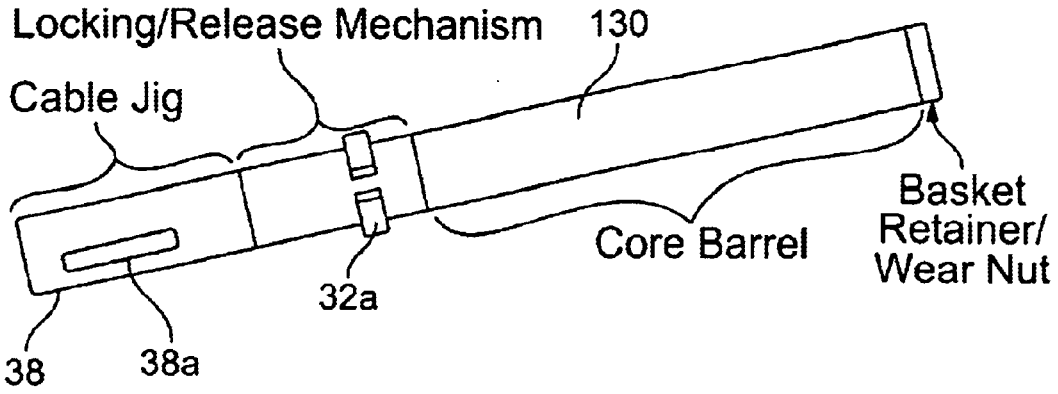
FIG. 16 illustrates a soil sampler mounted on the latch mechanism of the present invention to be lowered into the tool housing after passing through the rod string of the present invention.
Figure 17:
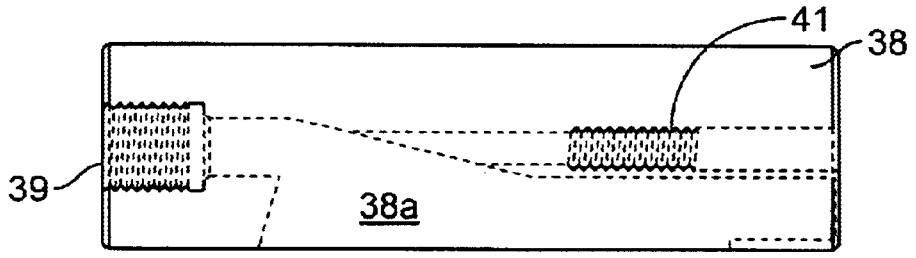
FIG. 17 is a side view of the connector block used in FIGS. 1, 3, 11 and 13 to interconnect the wireline with the lock mechanism.
Figure 18:
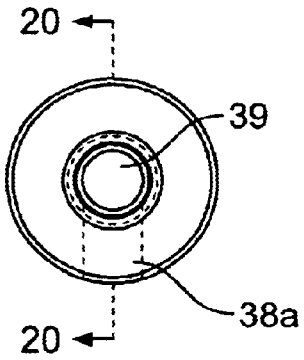
FIG. 18 is an end view of the connector block of FIG.
Figure 19:
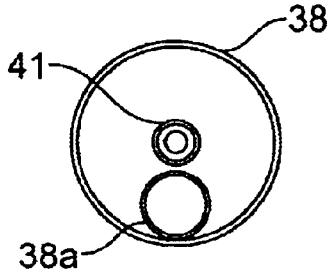
FIG. 19 is an opposite end view of the connector block shown in FIG. 17.
Figure 20:
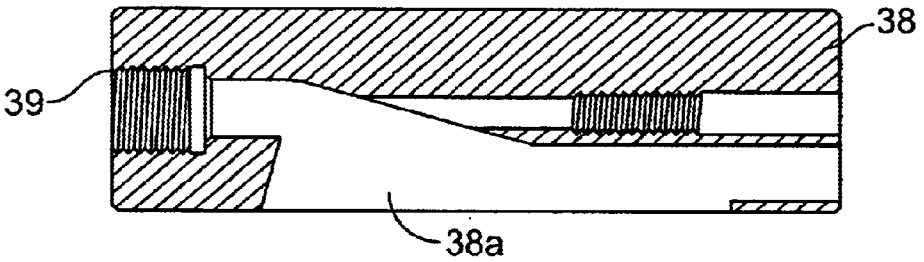
FIG. 20 is a sectional view taken along line 20—20 of FIG. 18.

Examples of other measurement or soil sampler modules are shown in FIGS. 13 through 16. In FIG. 13, a lock mechanism 40, including locking dogs 32*a*, 32*b*, locking wedge 48, compression spring 70, tension spring retaining washer 72 and tension spring retaining ring 74 are shown. In addition, pivot pins 46*a*, 46*b* are used to allow the pivoting of the locking dogs. Connector block 38 and wireline 36 are also shown. A leading end 80 of the latching mechanism is used to secure the latching mechanism to a measurement or soil sampler modular probe as shown in FIGS. 14, 15 and 16.

In FIG. 14, a piezocone module 24 is shown having tip 34, filter 82, O-rings 84, retainer ring 86, mini-piezo gauge housing 88, mini-piezo gauge 90, load cell sleeve 92, friction sleeve 94, spring ring 96, cable nut 98, male connector 100, cone connector ring 102, cone connector housing 104 and cone connector plug 106. The internal threading 108 is connected to the end 80 of the lock mechanism 40 for passing through the rod string to the position shown in FIGS. 1 and 3.

Similarly, a grout module 110 may be lowered by connection of the internal thread 112, secured to the end 80 of the lock mechanism 40. The grout module 110 includes a disposable grout tip 114 sealed by an O-ring 116. Hollow nylon tubing 118 extends through the hollow interior of the connected lock mechanism as well as the hollow internal cavity of the locking wedge and by connection with a hose barb union 120, to a further length of nylon tubing 122. Grout is passed through the latching mechanism to the grout module when the hole of the rod string is to be sealed by grout upon withdrawal of the grout module from the rod string.

By similar connection to the lock mechanism, a soil core sampler 130, as shown in FIG. 16, or vapor sampler, for example, may be lowered into the rod string and removed by the wireline connected to the lock mechanism. A plurality of different samplers or modules may thereby be lowered into or removed from a single rod string to achieve multiple testing through a single bore hole.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A method of conducting multiple characterizations of soil through a single bore hole, said method comprising:

embedding a rod string into the earth to form a single bore hole, by pushing the rod string directly into the earth by direct push technology, conducting a first soil characterization with a first probe, measurement or sampler module disposed at a leading end of the rod string, retrieving the first probe, measurement or sampler module from the bore hole, leaving an opening at the leading end of the rod string, and lowering a second probe, measurement or sampler module into the bore hole, to conduct a second soil characterization.

2. A method as claimed in claim 1, wherein the second module is connected to a lock mechanism that releasably secures the second module at the leading end of the bore hole.

3. A method as claimed in claim 2, wherein the first probe module is lowered into the bore hole after embedding the rod string.

4. A method as claimed in claim 2, wherein the latching mechanism comprises locking dogs that engage a groove within a leading rod of the rod string.

5. A method as claimed in claim 4, wherein the locking dogs are pivotally mounted on the lock mechanism.

6. A method as claimed in claim 4, wherein the locking dogs have outer surfaces that are chamfered at upper and lower edges.

7. A method as claimed in claim 2, wherein a wireline is connected to the lock mechanism for lowering and retrieving the second module.

8. A method as claimed in claim 7, wherein the wireline and the lock mechanism are coupled by a connecter block defining a passage therethrough for accommodating module instrument cables.

9. A method as claimed in claim 1, wherein the rod string has a nominal wall thickness of at least about 19 percent of a nominal outer diameter of the rod string.

10. A method as claimed in claim 1, wherein at least one of the first and second modules extends beyond the leading edge of the rod string when lowered into the bore hole for soil characterization.

11. A method as claimed in claim 1, wherein the first and second modules comprise a single module lowered into the bore hole multiple times.

12. A method as claimed in claim 1, wherein the first and second modules perform different soil characterization functions.

13. A method as claimed in claim 1, wherein at least one of the first and second soil characterizations comprises retrieving a sample of material from the earth.

14. A method as claimed in claim 1, wherein at least one of the first and second soil characterizations comprises remotely measuring a soil property.

15. A method as claimed in claim 1, wherein the second module is lowered to extend through the opening at the leading end of the rod string.

16. A wireline system for multiple direct push tool usage, said wireline system comprises:

a rod string comprising a plurality of hollow rods interconnectable to form a single bore hole therethrough when imbedded into the earth, and a probe module for passage through the bore hole, said probe module including a locking mechanism for locking the probe module at a leading end of the rod string in a deployment position with the probe module extending beyond the leading end of the rod string, said locking mechanism being connected to a wireline for lowering of the probe module through the bore hole for characterizing soil and retrieving the probe module from the bore hole after soil characterization, with the rod string embedded in the earth.

17. A wireline system as claimed in claim 16, wherein the locking mechanism has locking dogs that engage a groove in a leading rod of the rod string with the probe module in its deployment position.

18. A wireline system as claimed in claim 17, wherein the locking dogs are pivotally mounted on the locking mechanism.

19. A wireline system as claimed in claims 17, wherein the locking mechanism comprises a spring arranged to bias the locking dogs radially outwardly during downward passage through the bore hole.

20. A wireline system as claimed in claim 19, wherein the locking dogs are chamfered at upper and lower edges.

21. A wireline system as claimed in claim 16, further comprising a grout module for sealing the earth with grout as the rod string is removed after soil characterization.

22. A wireline system as claimed in claim 16, further comprising a soil sampler lowerable into the bore hole with the probe module removed, for obtaining a physical sample of soil from the leading end of the rod string without withdrawing the rod string from the earth.

23. A wireline system as claimed in claim 16, wherein the rod string has a nominal wall thickness of at least about 19 percent of a nominal diameter of the rod string.

24. A wireline system, as claimed in claim 16, the locking mechanism is connected to the wireline by a connector block defining a passage therethrough for accommodating cables extending along the bore hole.

25. A wireline system as claimed in claim 24, wherein a cable extends through said passage and is connected to said probe module.

* * * * *